US006861627B2

(12) United States Patent
Wasai et al.

(10) Patent No.: US 6,861,627 B2
(45) Date of Patent: Mar. 1, 2005

(54) INDUCTION HEAT FIXING DEVICE

(75) Inventors: Akihiro Wasai, Shizuoka-ken (JP); Kazuhiko Kikuchi, Kanagawa-ken (JP); Osamu Takagi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/807,366

(22) Filed: Mar. 24, 2004

(65) Prior Publication Data

US 2004/0188422 A1 Sep. 30, 2004

(30) Foreign Application Priority Data

Mar. 26, 2003 (JP) ..... 2003-085899
Mar. 26, 2003 (JP) ..... 2003-085900
Mar. 26, 2003 (JP) ..... 2003-085901
Mar. 26, 2003 (JP) ..... 2003-085902
Mar. 29, 2003 (JP) ..... 2003-085903

(51) Int. Cl.[7] ..... G03G 15/20; H05B 6/14
(52) U.S. Cl. ..... 219/619; 219/674; 399/334
(58) Field of Search ..... 219/619, 674, 219/676; 399/328–334

(56) References Cited

U.S. PATENT DOCUMENTS 3,508,024 A * 4/1970 Cannon ..... 219/619
5,822,669 A * 10/1998 Okabayashi et al. ..... 399/330
5,970,592 A * 10/1999 Feldhoff et al. ..... 219/619
6,337,969 B1 1/2002 Takagi et al.
6,340,810 B2 * 1/2002 Yokoyama et al. ..... 219/619
6,415,128 B1 7/2002 Takagi et al.
6,522,846 B2 2/2003 Kinouchi et al.
6,724,999 B2 4/2004 Kikuchi et al.
6,725,000 B2 4/2004 Takagi et al.
2002/0031381 A1 3/2002 Miyahara et al.
2002/0125244 A1 * 9/2002 Yokozeki et al. ..... 219/619
2003/0000943 A1 * 1/2003 Yokozeki ..... 219/619
2003/0042251 A1 * 3/2003 Kitano et al. ..... 219/619
2003/0091362 A1 5/2003 Kinouchi et al.
2003/0213799 A1 * 11/2003 Tanaka et al. ..... 219/619
2003/0215255 A1 11/2003 Kinouchi et al.
2003/0219271 A1 11/2003 Kinouchi et al.

FOREIGN PATENT DOCUMENTS

JP 2001-312165 A 11/2001

OTHER PUBLICATIONS

U.S. Appl. No. 10/391,627, filed Mar. 20, 2003, Wasai.
U.S. Appl. No. 10/455,419, filed Jun. 6, 2003, Takagi et al.
U.S. Appl. No. 10/806,392, filed Mar. 23, 2004, Takagi et al.
U.S. Appl. No. 10/807,428, filed Mar. 24, 2004, Kikuchi et al.
U.S. Appl. No. 10/872,472, filed Jun. 22, 2004, Kinouchi et al.

* cited by examiner

*Primary Examiner*—Teresa J. Walberg
(74) *Attorney, Agent, or Firm*—Foley & Lardner LLP

(57) ABSTRACT

An induction heat fixing device has coil portions with electric wires wound around the outer surface of a cylindrical main bobbin, grooves and flanges formed at both ends of the main bobbin. Further, plural ribs are formed in the main bobbin. The main bobbin is put into a holder with these ribs brought in contact with the holder.

5 Claims, 15 Drawing Sheets

INDUCTION HEAT FIXING DEVICE

CROSS-REFERENCE TO RELATED APPLICATIONS

This application is based upon and claims the benefit of priority from the prior Japanese Patent Applications No. 2003-085899, filed on Mar. 26, 2003; No. 2003-085900, filed on Mar. 26, 2003; No. 2003-085901, filed on Mar. 26, 2003; No. 2003-085902, filed on Mar. 26, 2003, and No. 2003-085903, filed on Mar. 26, 2003; the entire contents of which are incorporated herein by reference.

BACKGROUND OF THE INVENTION

1. Field of the Invention

This invention relates to an induction heat fixing device, which is incorporated in such image forming apparatus as copying machines, printers, etc.

2. Description of the Related Art

As a heat source of a fixing device used in a copying machine, there is an induction heat. A fixing device utilizing this induction heat is to heat a fixing roller made of a metal electric conductor by eddy current generated by electromagnetic wave. An induction coil spirally wound around a non-magnetic bobbin is provided in the fixing roller and high frequency current is applied to this induction coil. Induction eddy current is generated in the fixing roller by the high frequency magnetic field generated by this applied current and the fixing roller itself is heated by Joule heat as a result of the surface resistance of the fixing roller. This bobbin is divided into 3 portions; a central main bobbin and slave bobbins that are connected to both side of the main bobbin for the purpose of easy manufacture and simple repair. Each of these bobbin members is wound with a conductor and is made an induction coil (disclosed in the Japanese Patent Publication No. 2001-312165).

In recent years, as a technology to cope with the energy saving, the cut-down of a warm-up time has become as a technical problem and it is pointed out to make the thickness of a heat roller thin as a measure to achieve the warm-up time cut-down. However, in a fixing device, various kinds of paper sizes are used and sheets of paper in narrow width are supplied successively and the heat of the portion of the heat roller outside the size of supplied narrow wide paper is not taken away by paper. So, the temperature of those portions becomes higher than the temperature of the paper width portion or when paper in large width are supplied after paper in a narrow width, the fixing becomes defective by the high temperature offset. The thinner the thickness of a heat roller is (the less the heat capacity is, the more this phenomenon becomes remarkable.

Further, for manufacturing coils that are composing a fixing device, the achievement of more efficient and easy manufacturing, etc. is so far demanded.

The induction heat fixing device disclosed in the above-mentioned Japanese Patent Publication No. 2001-312165 is simply to induce the heating of a heat roller by plural induction coils divided according to widths of transfer sheets and the decrease of energy loss by winding wires of induction coils is not taken into consideration. On the other hand, for further energy saving of a device in inducing the heating of a heat roller using induction coils, further decrease of loss caused by winding wires of induction coils; for example, copper loss, iron loss caused from a material of heat roller, etc. is demanded and the achievement of practical use of a fixing device to obtain a higher efficient and good fixing is demanded.

SUMMARY OF THE INVENTION

It is an object of this invention to provide an induction heat fixing device excellent in practical usability and reliability.

A further object of this invention is to provide a fixing device that is excellent in practical use and highly reliable by obtaining induction coils with high production efficiency for more energy saving when a heat roller is heated.

According to this invention, there is provided an induction heat fixing device comprising: a heat roller; a magnetic field generator; and a pressure roller that rotates jointly with the heat roller while kept in contact with the heat roller; wherein the magnetic field generator includes: a cylindrical bobbin with an electric wire wound around to form a coil on the outer surface and flanges formed at both ends of the main bobbin.

Further, according to this invention, there is provided an induction heat fixing device comprising: a heat roller; plural coil unit groups to generate eddy current in the heat roller to heat the heat roller; and a pressure roller that rotates jointly with the heat roller while kept in contact with heat roller, wherein the coil unit groups includes: a holder that is arranged in the heat roller; coil supporting members that are inserted into the holder; coils comprising winding wires wound around the outer surface of the coil supporting members in plural turns; and plural coil units provided on the inner surface of the coil supporting members in parallel with the inserting direction and have tubular guides to pass the winding wire pulled out of the coil and lead in the end direction of the holder and arranged adjoining to the holder.

DETAILED DESCRIPTION OF THE INVENTION

A first embodiment of an induction heat fixing device of this invention will be explained below referring to the attached drawings.

Figure 1:
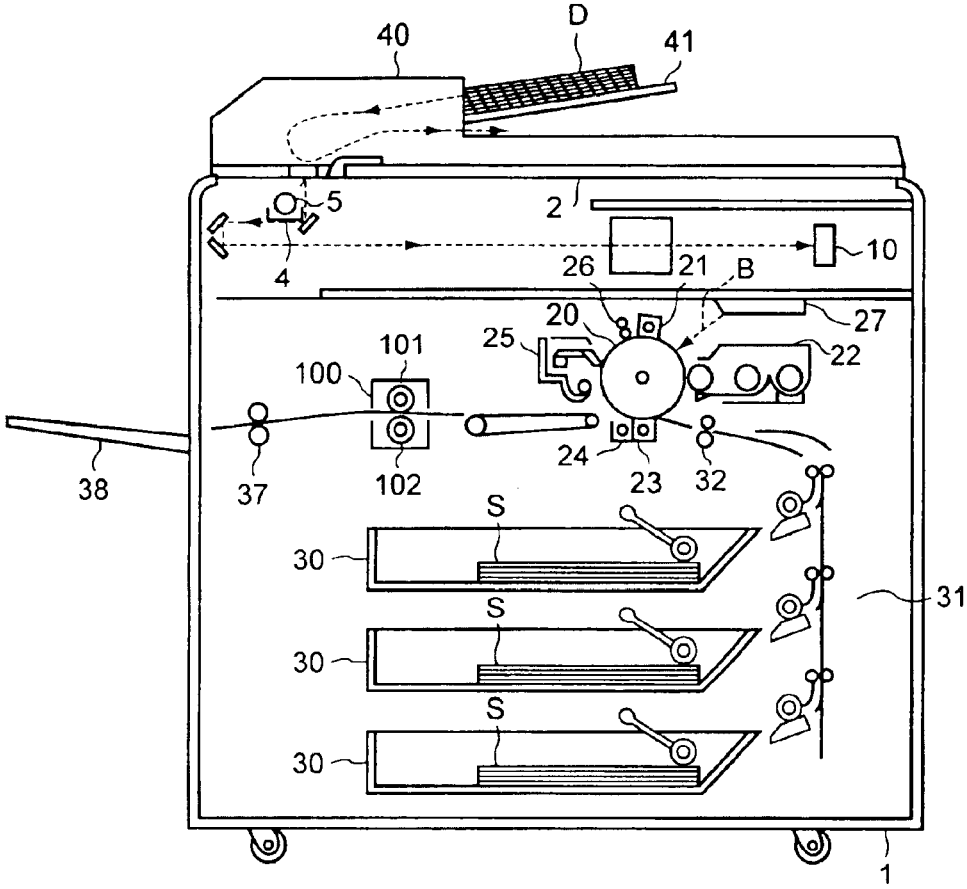
FIG. 1 is a schematic diagram showing the inner construction of an image forming apparatus to which the induction heat fixing device of this invention is applied, for example, a multi-functional electronic copying machine.

First, FIG. 1 shows the inner construction of an image forming apparatus; for example, a multi-functional electronic copying machine. On the top of a main body 1, a transparent document table (a platen glass) 2 is provided for placing documents. When an exposure lamp 5 provided on a carriage 4 is lighted, a document D placed on document table 2 is exposed.

The reflecting light of this exposure is projected to a photoelectric conversion device; for example, a CCD (Charge Coupled Device) 10 and an image signal is output. An image signal that is output from CCD 10 is converted into a digital signal and this digital signal is supplied to a laser unit 27. Laser unit 27 emits laser beam B corresponding to this input signal.

On the top surface of main body 1, a control panel (not illustrated) is provided for setting operating conditions at a position where an automatic document feeder 40 is not put over. This control panel is provided with a touch panel type LC display, numeric-keys to input numerals, a copy start key, etc.

On the other hand, a photoconductive drum is provided rotatably at almost the center in main body 1. Around photoconductive drum 20, a main charger 21, a developing unit 22, a transferring unit 23, a separation unit 24, a cleaner 25 and a charge eliminator 26 are arranged sequentially. A toner image is formed on photoconductive drum 20 according to a known processing method and is then transferred on a sheet of paper S. The sheet of paper S with the toner image transferred thereon is heated and fixed on the sheet of paper S by a fixing device 100 that will be described later.

Below photoconductive drum 10 of main body 1, there is provided paper supply cassettes 30 containing sheets of paper S. An aligning roller 32 is provided between paper supply cassette 30 and transferring unit 23 to convey the sheet of paper S that is taken out from a paper supply cassette and supplied in the direction of transferring unit 23 by a paper feeding portion 31 in synchronous with a toner image formed on photoconductive drum 20.

Figure 2:
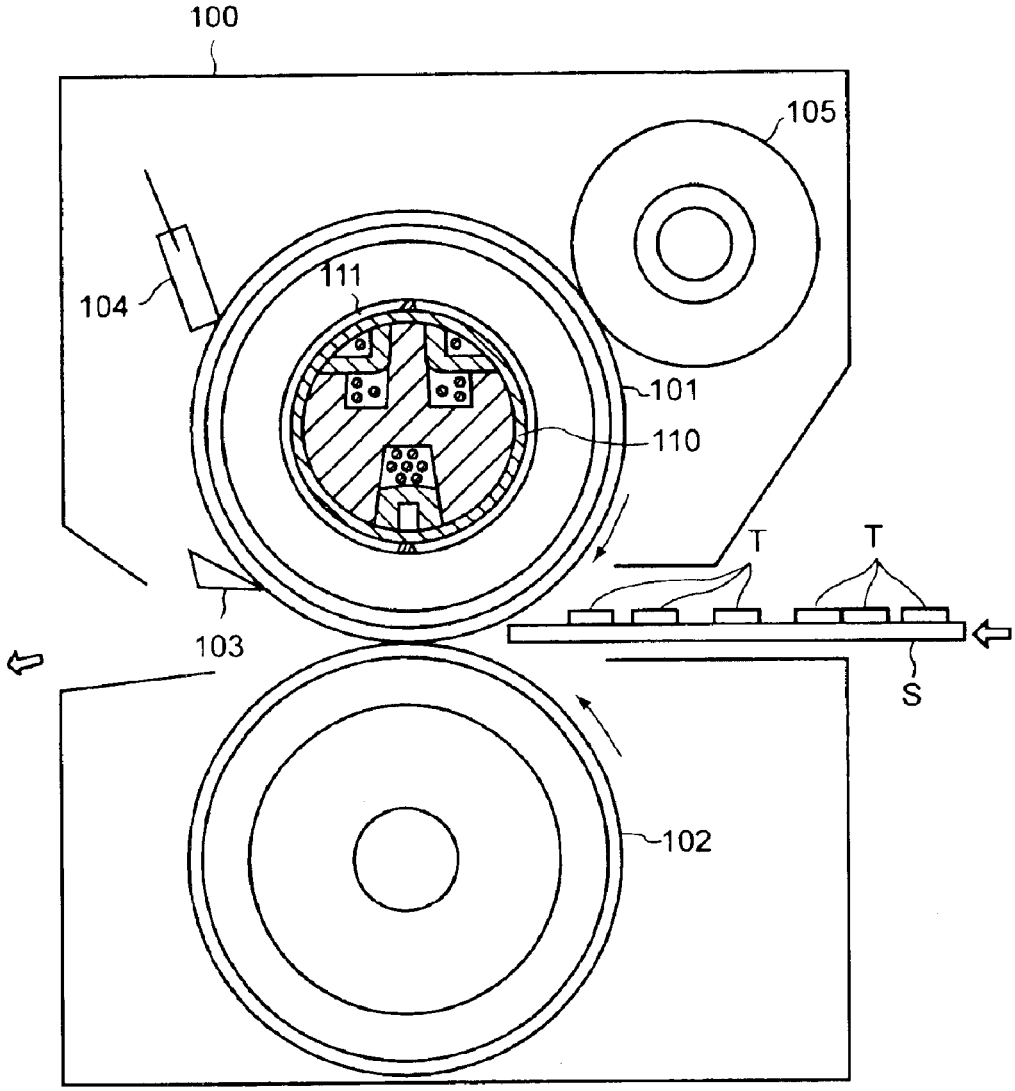
FIG. 2 is a schematic side view showing the construction of the induction heat fixing device in a first embodiment of this invention.

A definite construction of fixing device 100 is shown in FIG. 2.

At positions above and lower a conveying path of the sheet of paper S, a heat roller 101 and a pressure roller 102 are provided. Pressure roller 102 is kept in contact with the peripheral surface of heat roller 12 in the pressing state by a pressure mechanism (not illustrated). The contacting portions of these rollers 101 and 102 are in a certain nip width.

Heat roller 101 is made of a conductive material, for example, iron formed in a cylindrical shape with its outer peripheral surface covered by a separation layer and is rotated clockwise. Pressure roller 102 rotates counterclockwise when heat roller 101 is rotated. When the sheet of paper S passes between the contacting portions of heat roller 101 and pressure roller 102 and is heated by heat roller 101, a toner image T on the sheet of paper S is fixed thereon.

Around heat roller 101, there are provided a separation claw 103 for separating the sheet of paper S from heat roller 101, a cleaner 104 for removing toner, paper waste, etc. remaining on heat roller 101, and an application roller 105 for applying a release agent on the surface of heat roller 101.

A coil 111 for induction heating is housed in the inside of heat roller 101. Coil 111 is wound around a bobbin 110 and held by it, and produces a high frequency magnetic field for induction heating. When this high frequency magnetic field is produced, eddy current is generated on heat roller 101 and heat roller 101 is self heated by Joule heat of this eddy current.

Figure 3:
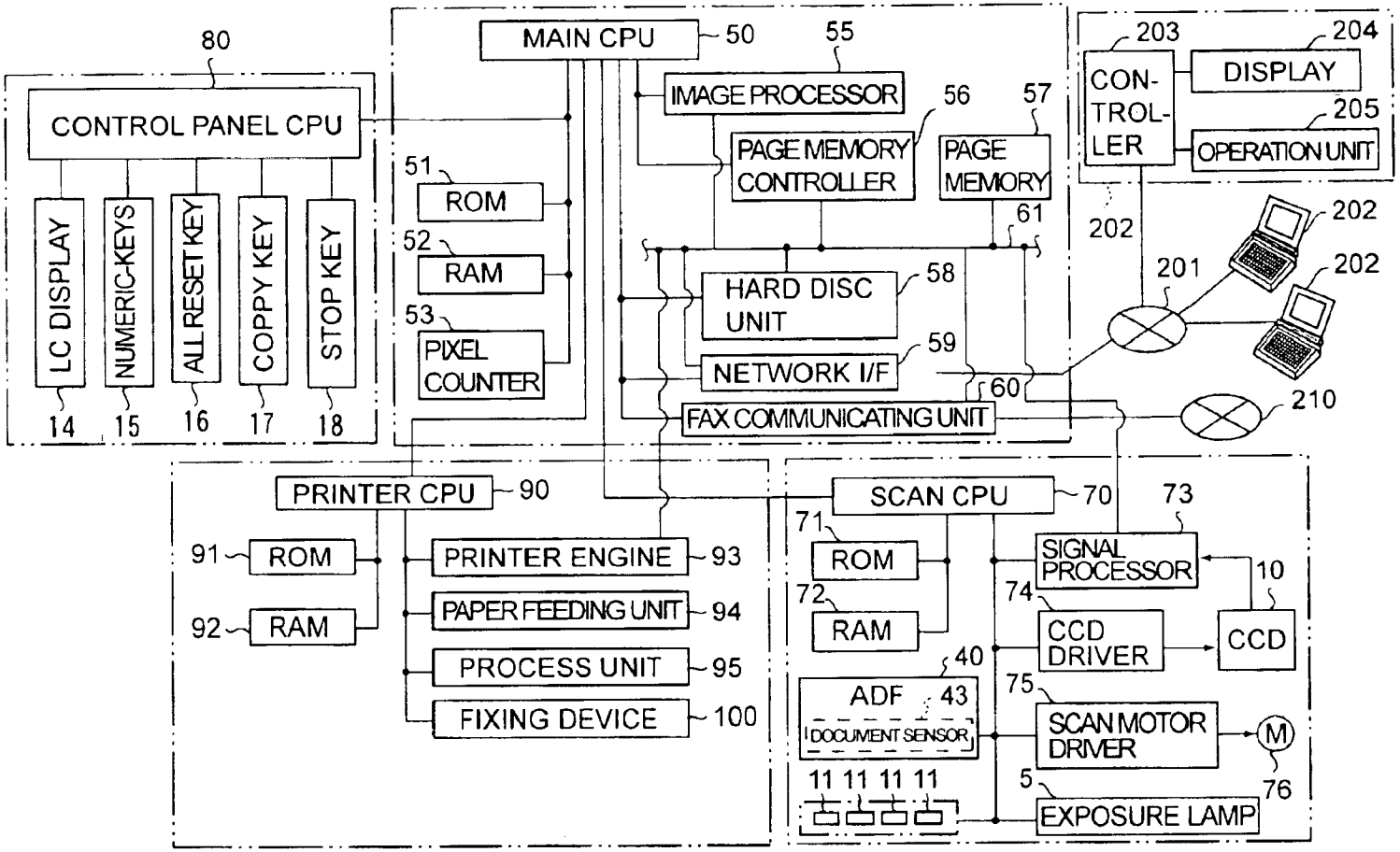
FIG. 3 is a block diagram showing control circuits of the multi-functional electronic copying machine shown in FIG. 1.

The control circuit of main body 1 is shown in FIG. 3.

A main CPU 50 is connected with a scan CPU 70, a control panel CPU 80 and a printer CPU 90. Main CPU 50 controls scan CPU 70, control panel CPU 80 and printer CPU 90 totally. Further, main CPU 50 is provided with a copy mode control means corresponding to the copy key operation, a printer mode control means responding to an image input to a network interface 59 that will be described later, and a FAX (facsimile) mode control means responding to an image received by a FAX communication unit that will be described later.

Main CPU 50 is also connected with a ROM 51 for control program storing, a RAM 52 for data storing, a pixel counter 53, an image processor 55, a page memory controller 56, a hard disc unit 58, a network interface 59, and FAX communication unit 60.

Page memory controller 56 controls write/read of image data to/from a page memory 57. Image processor 55, page memory controller 56, page memory 57, hard disc unit 58, network interface 59 and FAX communication unit 60 are mutually connected by an image data bus.

Network interface 59 functions as a printer mode input unit to which images (image data) transmitted from external equipment are input. A communication network 201 such as LAN or Internet is connected to this network interface 59. External equipment, for example, plural units of a personal computer 202 are connected to communication network 201. Each of these personal computers 202 is provided with a controller 203, a display 204 and an operation unit 205.

FAX communication unit 60 is connected to a telephone communication 210 and functions as a facsimile mode receiving unit to receive image data transmitted via telephone communication 210.

Scan CPU 70 is connected with a ROM 71 for control program storing, a ROM 72 for data storing, a signal processor 73 to process the output of CCD 10 and supply to image data bus 61, a CCD driver 74, a scan motor driver 75, exposure lamp 5, automatic document feeder 40 and plural document sensors 11. CCD driver 74 drives CCD 10. Scan motor driver 75 drives a scan motor 76 for carriage driving. Automatic document feeder 40 has a document sensor 43 for detecting a document D that is set on a tray 41 and its size.

Control panel CPU 80 is connected with touch panel type LC display 14, numeric-keys 15, an all reset key 16, copy start key 16 and a stop key 18.

Printer CPU 90 is connected with a ROM 91 for control program storing, a RAM 92 for data storing, a printer engine 93, a paper feeding unit 94, a process unit 95 and fixing device 100. Printer engine 93 is composed of laser unit 27 (FIG. 1) and its driving circuit. Paper feeding unit 94 is composed of a paper feeding mechanism from paper supply cassette 30 to tray 38 (FIG. 1) and its driving circuit. Process unit 95 is composed of photoconductive drum 20 (FIG. 1) and its peripheral units.

A printer unit to print images processed by image processor 55 on paper is composed of mainly printer CPU 90 and its peripheral units.

Figure 4:
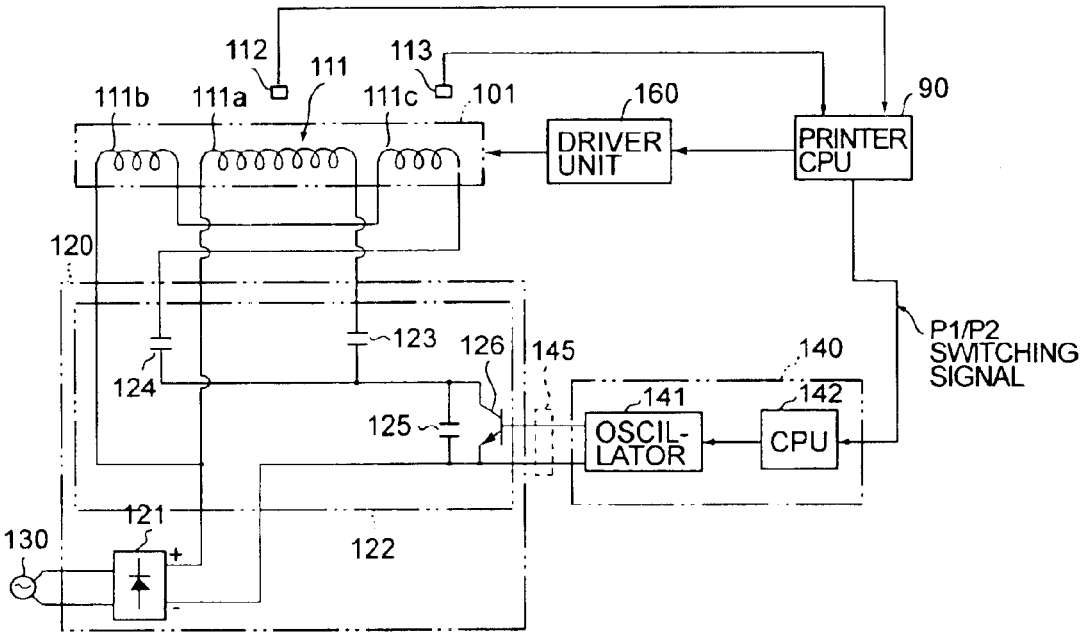
FIG. 4 is an electric circuit diagram of the induction heat fixing device shown in FIG. 2.

The electric circuit of fixing device 100 is shown in FIG. 4.

Coil 111 in the inside of heat roller 101 is branched into three coils; 111*a*, 111*b* and 111*c*. Coil 111*a* is provided at the central portion of heat roller 101 and coils 111*b* and 111*c* are provided at both sides of coil 111*a*. For example, in the fixing of a large size sheet of paper S, all coils 111*a*, 111*b* and 111*c* are used. In the fixing of a small size sheet of paper S, coil 111*a* only is used. These coils 111*a*, 111*b* and 111*c* are connected to a high frequency generating circuit 120.

A temperature sensor 112 is provided to the central portion of heat roller 101 to detect a temperature of the central portion. A temperature sensor 113 is provided at one end of heat roller 101 to detect a temperature of the one end. These temperature sensors 112 and 113 are connected to printer CPU 90 jointly with a driver unit 160 that is for rotating and driving heat roller 101. Printer CPU 90 controls driver unit 160. Further, printer CPU 90 generates a P1/P2 switching signal to designate the operation of a first series resonance circuit (output power P1), composed of coil 111*a* and a second series resonance circuit (output power P2) composed of coils 111*b* and 111*c*, described later. Further, printer CPU 90 controls output power P1 and P2 of respective series resonance circuits responding to detected temperatures of temperature sensors 112 and 113.

High frequency generating circuit 120 generates high frequency power for generating a high frequency magnetic field. High frequency generating circuit 120 is equipped with a switching circuit 122 connected to a rectifier circuit 121 and the output end of this rectifier circuit 121. Rectifier circuit 121 rectifies AC voltage of commercial alternating current source 130. Switching circuit 122 forms the first series resonance circuit with coil 111*a* and capacitors 123 and 125. The second series resonance circuit is formed with series connected coils 111*b* and 111*c* and capacitors 124 and 125. These series resonance circuits are selectively excited by a switching element; for example, FET such as a transistor 126.

The first series resonance circuit has a resonant frequency f1 that is decided by an inductance L1 of coil 111*a*, a capacitance C1 of capacitor 123 and a capacitance C3 of capacitor 125. The second series resonance circuit has a resonant frequency f2 that is decided by a capacitance C2 of capacitor 124 and capacitance C3 of capacitor 125.

Transistor 126 is turned on/off by a controller 140 according to the P1/P2 switching signal from printer CPU 90. Controller 140 has an oscillator 141 and a CPU 142. Oscillator 141 generates a drive signal of specified frequency for transistor 126. CPU 142 controls the oscillation frequency (drive signal frequency) of oscillator 141 and has following means (1) and (2) as principal functions.

(1) A control means to excite the first series resonance circuit sequentially (alternately) by plural frequencies near its resonance frequency f1; for example, (f1−Δf) and (f1+Δf) when the operation of the first series resonance circuit (using coil 111*a* only) is specified by the P1/P2 switching signal from printer CPU 90.

(2) A means to excite the first and the second series resonance circuits by plural frequencies near their resonance frequencies f1 and f2; for example (f1−Δf), (f1+Δf), (f2−Δf) and (f2+Δf) Sequentially when the operations of the first and the second series resonance circuits (using all coils 111*a*, 111*b* and 111*c*) are specified by the P1/P2 switching signal from printer CPU 90.

Next, the actions of the construction described above will be explained.

When the drive signal of the same frequency (or near frequency) as the resonance frequency f1 of the first series resonance circuit is generated from oscillator 141, transistor 126 is turned on/off by this drive signal and the first series resonance circuit is excited. By this excitation, a high frequency magnetic field is generated from coil 111*a*, eddy current is generated at the central portion in the axial direction of heat roller 101, and the central portion of heat roller 101 is self heated by Joule heat of this eddy current.

When the drive signal of the same frequency (or near frequency) as the resonance frequency f2 of the second series resonance circuit is generated from oscillator 141, transistor 126 is turned on/off by this drive signal and the second series resonance circuit is excited. By this excitation, a high frequency magnetic field is generated from coils 111*b* and 111*c*, eddy current is generated at both sides in the axial direction of heat roller 101 and the both sides are self heated by Joule heat of this eddy current.

Figure 5:
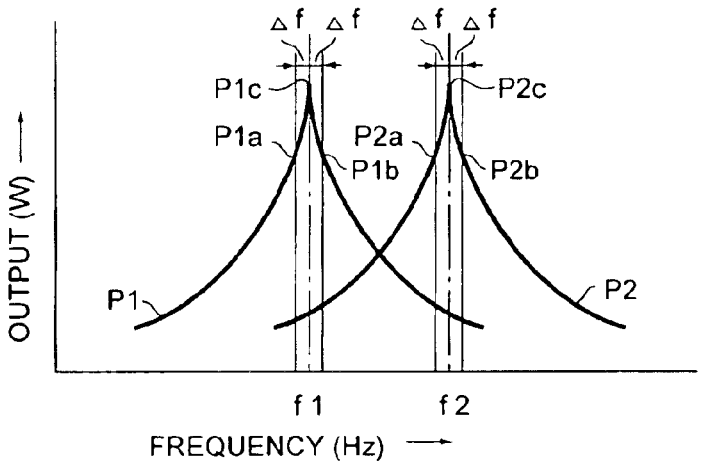
FIG. 5 is a graph showing the relationship between output power of series resonance circuits and frequency, which excites respective series resonance circuits in the induction heat fixing device shown in FIG. 2.

The relationship between the output power P1 of the first series resonance circuit and frequency to excite the first series resonance circuit and the relationship between the output power P2 of the second series resonance circuit and frequency to excite the second series resonance circuit are shown in FIG. 5.

That is, the output power P1 becomes the peak level when excited with the same frequency as the resonance frequency f1 of the first series resonance circuit and shows a pattern to gradually decrease in a rainbow curve when the exciting frequency leaves from the resonance frequency f1. Similarly, the output power P2 becomes the peak level when excited with the same frequency as the resonance frequency f2 of the second series resonance circuit and shows a pattern to gradually decrease in a rainbow curve with the exciting frequency leaves from the resonance frequency f2.

When fixing a large size sheet of paper S, both the first and second series resonance circuits are excited and a high frequency magnetic field is generated from all coils 111*a*, 111*b* and 111*c*. Eddy current is generated in the entire heat roller by this high frequency magnetic field and the entire heat roller 101 is self heated by the Joule heat produced by this eddy current.

In this case, drive signals having two frequencies (f1−Δf) and (f1+Δf) that are separated high and low by a specified value Δf centering around resonance frequency f1 of the first series resonance circuit are output sequentially from oscillator 141. In succession, drive signals having two frequencies (f2−Δf)m (f2+Δf) that are separated high and low by a specified value Δf centering around resonance frequency of the second series resonance circuit are output sequentially from oscillator 141.

By these drive signals, the first series resonance circuit is excited sequentially with two frequencies (f1−Δf) and (f1+Δf) above and low the resonance frequency f1. In succession, the second series resonance circuit is excited sequentially with two frequencies(f2−Δf) and (f2+Δf) higher and lower than the resonance frequency f2. The excitation for each frequency is thus repeated.

The output power P1 of coil 111*a* in the first series resonance circuit becomes a value P1*a* slightly lower than the peak level P1*c* when excited with the frequency (f1−Δf) and also, becomes a value P1*b* slightly lower than the peak level P1*c* when excited with the frequency (f1+Δf) as shown in FIG. 5.

The output power P2 of coils 111*b* and 111*c* in the second series resonance circuit becomes a value P2*a*slightly lower than the peak level P2*c*when excited with frequency f2−Δf) and also becomes a value P2*b*slightly lower than the peak level P2*c*when excited with the frequency (f2+Δf).

Figure 6:
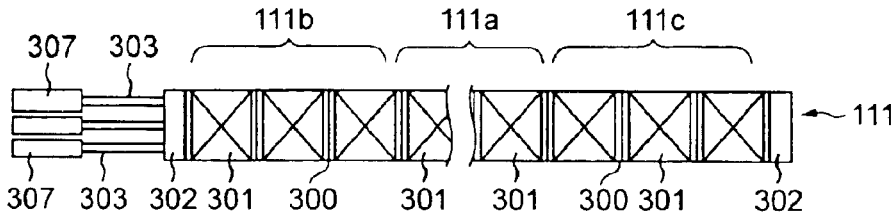
FIG. 6 is a diagram showing the outline of a magnetic field generator (a coil)

The outline of a magnetic generator (hereinafter, called as a coil) 111 involved in this invention is shown in FIG. 6.

Coil 111 is composed of, for example, center coil 111*a* that has a coil portion 301 divided and wound around 6 bobbin assemblies 300 and side coils 111*b* and 111*c* that have coil portions 301 divided and wound around 3 bobbins and arranged at both sides of center coil 111*a*. These plural bobbin assemblies 300 are made in a solid construction by sequentially fit into a single holder, which will be described later, with both ends of the holder fixed with a cap 302. Same kind lead wires 303 of respective coil portions 301 are bundled and led out from one side of cap 302.

Figure 7:
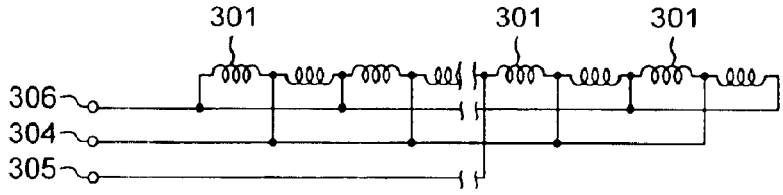
FIG. 7 is an electric circuit diagram of the magnetic field generator.
Figure 8:
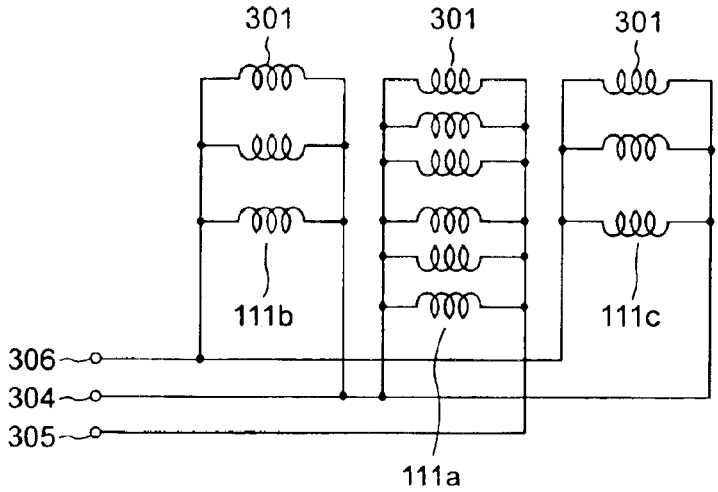
FIG. 8 is an equivalent circuit diagram of the magnetic field generator.

The electrical connection of coil 111 is as shown in FIG. 7. One end of each coil portion 301, that is, for example, the low voltage side for 0 [V] is connected to a common terminal 304. The end of coil 301 of center coil 111*a*, that become the other ends, for example, high potential ends of 1,000 [V] are commonly connected to the high voltage side first terminal 305, and high potential ends of 1,000 [V] that become the other ends of both side coils 111*b* and 111*c* are commonly connected to the high voltage side second terminal 306.

In an equivalent circuit, six coil portions 301 composing center coil 111*a* are connected in parallel between common terminal 304 and first terminal 305, and three coil portions 301 composing both side coils 111*b* and 111*c* are connected in parallel between common terminal 304 and second terminal 306.

In the actual construction, all lead wires from both ends of coil portions 301 are pulled out from each coil portion 3012. Twelve lead wires are led out from common terminal 304 and six lead wires 303 are led out from each of first and second terminals 305 and 306. These lines are bundled and connected to terminal pins (or terminal sockets) 307.

Figure 9:
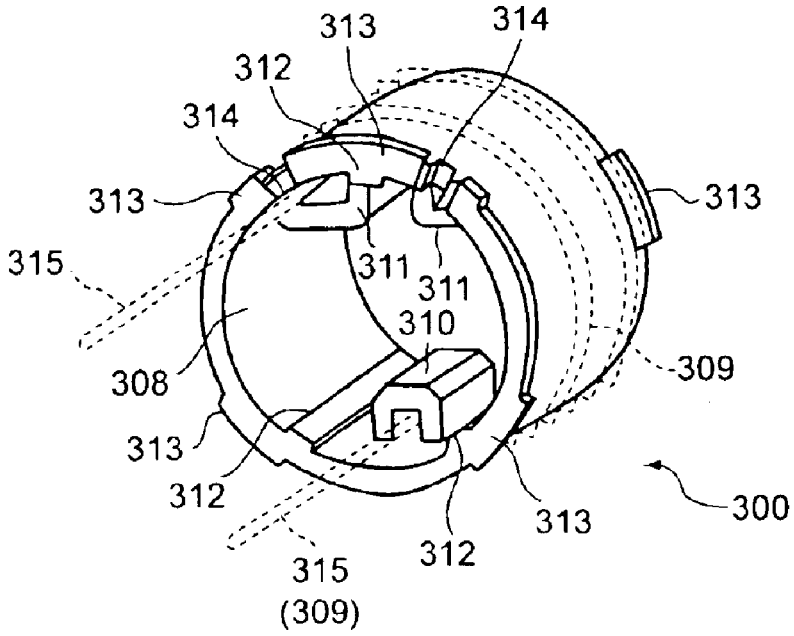
FIG. 9 is a perspective view showing a bobbin composing the magnetic field generator.

These coil portions 301 are wound around cylindrical bobbin assembly 300 made of nonmagnetic insulator. In the inside of a main bobbin 308 formed in almost cylindrical shape, a casing with a space almost in a horseshoe shape electric wire guide 310 provided to pass electric wires 309 is formed in its axial direction as shown in FIG. 9. In the inside of main bobbin 308 opposing to electric wire guide 310, for example, L-shaped electric wire guide pairs 311 are formed at both sides symmetrically when viewed from electric wire guide 310 similarly in the axial direction.

At the midpoint of this L-shape electric wire guide pair 311, preferably on the inner wall surface of the main bobbin at the central portion, ribs 312 projecting in a radial pattern in the center direction from this inner wall surface are formed in the axial direction of main bobbin 308 and further, a rib pair 312 is formed similarly at both sides of horseshoe shape electric wire guide 310. For the structure of a mold to cast bobbin assembly 300, it is necessary to make ribs 312 tapered on the inner surface of man body 308 in the pull-out direction. As it is difficult to fix the inner wall of main bobbin 308 in the state fully contacted with the outer wall surface of a holder that will be described later and therefore, it is necessary to taper ribs 312 in order to fix the position between them. For this reason, ribs 312 are required at more than 3 points on the inner surface of main bobbin 308 for the accurate positioning and so set that an angle made between adjacent ribs 312 becomes less than 180°. The height of ribs 312 is also set at less than the diameter of electric wire 309 against the maximum inner diameter of main bobbin 308. The space of the tip of ribs 312 is not so large and does not become an obstacle when pulling out a mold.

Rib 312 can be made sharp at its end, dot or line shape without making flat. When ribs 312 are constructed in such shape, it becomes possible to display a strong elasticity when installing a holder and not only some molding error can be absorbed but also a holder can be fixed firmly utilizing this elasticity.

Figure 10:
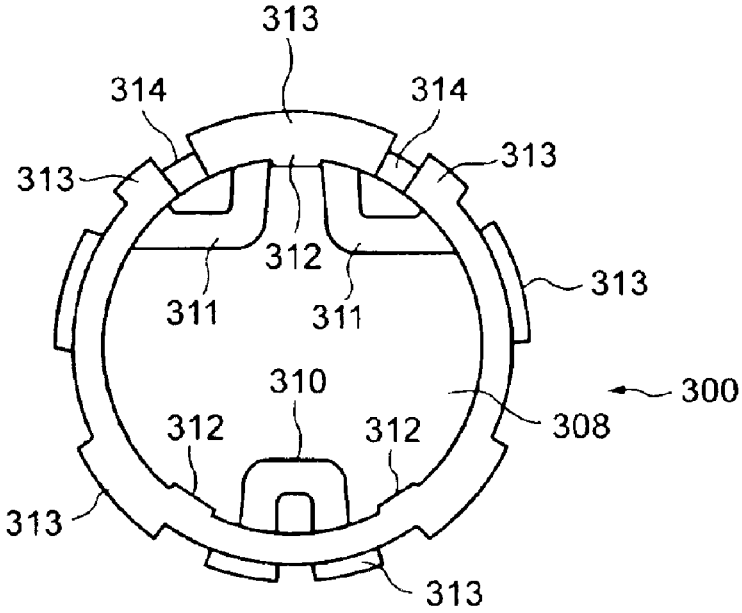
FIG. 10 is a plan view of the bobbin shown in FIG. 9 viewed from one end surface.
Figure 11:
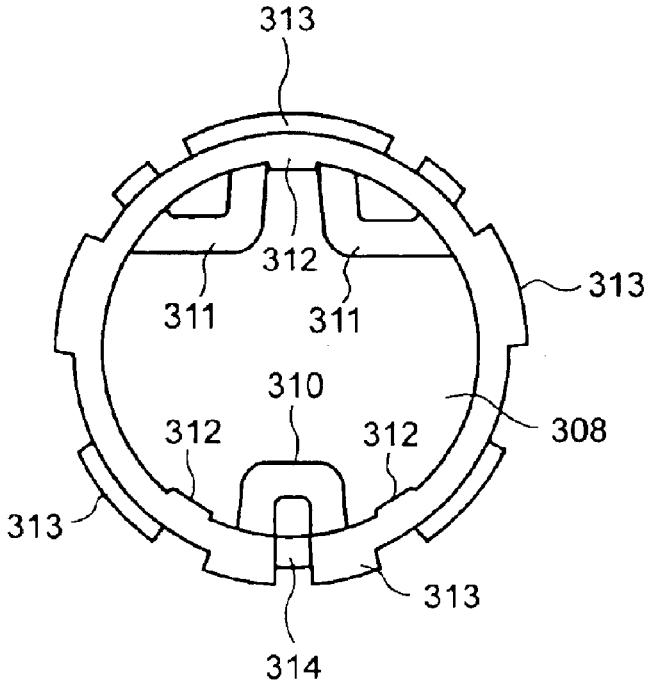
FIG. 11 is a plan view of the bobbin shown in FIG. 9 viewed from the other end surface.

Further, plural flanges 313 are formed at both ends developing in a radial pattern with a specified space in the outer surface to prevent electric wire 309 from falling off from main bobbin 308 when winding it around the outer surface of main bobbin 308. When main bobbin 308 is viewed from one end and the other end as shown in FIG. 10 showing it viewed from one side and FIG. 11 showing it viewed from the other side, flanges 313 formed at the positions of respective ends are not overlapped but can be seen through each other. This arrangement of flanges 313 is a devise to solve the problem involved in pulling out a mold when molding bobbin assembly 300.

Flange 313 is arranged at one point as the minimum on one side and when only one flange 313 is provided to bobbin assembly 300, the length of flange 313 in its peripheral surface direction is set so that the size of a space portion without flange 313 provided becomes less than 180° to prevent electric wire 309 from coming out of the outer surface of main bobbin 309. Further, when plural flanges 313 are arranged in the peripheral direction, flanges 313 should be arranged at certain intervals and flanges 313 formed at both ends of main bobbin 308 do not overlap mutually in the axial direction. Thus, by constructing main bobbin 308 so as to enable to pull out a mold in the axial direction of bobbin assembly 300, the construction of a mold can be simplified and its manufacturing cost can be reduced.

On the end surface of main bobbin between flanges 313, a groove 314 is provided in the radial direction to connect the inner and outer sides of main bobbin 308. Groove 314 is provided at a position opposing to L-shape electric wire guide 311 at one end surface and at a position opposing to horseshoe shape electric wire guide 319 at the other end surface. In other words, flange 313 is provided at both sides of groove 314. When electric wire 309 is wound around the outer surface of main bobbin 308, groove 314 pulls out the beginning and ending portions of lead wire 315 from main bobbin 308 to the inside. Lead wire 315 at the side opposite to the leading direction I is pulled out in the same leading direction through groove 314 and electric wire guide.

When adjacent main bobbins 308 are brought in contact with each other, groove 314 prevents electric wire 309 pulled in the inside of main bobbin 308 from clamped between main bobbins 308. And at the same time, because flanges 313 formed at both sides of groove 314 function as the guides of electric wire 309, groove 314 also has a function to promote the efficiency of the winding work and act as a stopper to prevent electric wire 309 from being pulled out when the winding is completed. It is desirable to provide the ditch portion at a position within ±90° to the space in bobbin 308 into which electric wire 309 is inserted because electric wire 309 can be led effectively into the space portion through which electric wire 309 passes.

When bobbin assembly 300 that is constructed as described above is viewed from respective end directions, the end faces are in the symmetrical state with the axis as the center and therefore, a bobbin assembly 300 can be installed in a holder even when its front and rear are reversed. For example, when the wire is wound by reversing the winding direction or when bobbins are fit into a holder sequentially by opposing the same potential portions each other, bobbin assemblies 300 in the same shape can be used as they are. Accordingly, when bobbins in small kinds are made available, the mass production is enabled.

Respective coil portions 301 in the structure with electric wire 309 wound around the outer surface of main bobbin 308 and lead wire portions 315 made in the same direction are fit on the outer surface of the axially slender holder sequentially and coil 111 is thus composed.

Figure 12:
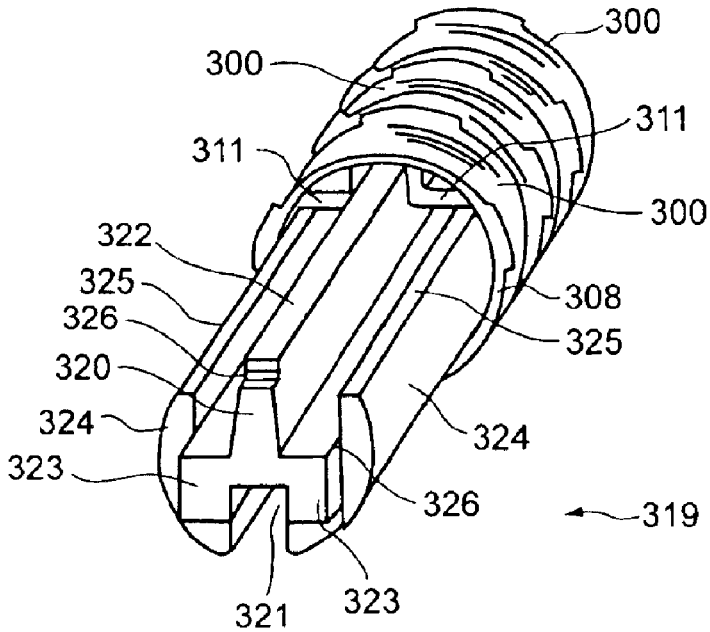
FIG. 12 is a perspective view showing a holder composing the magnetic field generator.

In a holder 319, electric wire guide 310 provided on main bobbin 308 is fit to the bottom portion opposite to a centrally projecting portion 320 in almost concave shape section at the central portion as shown in FIG. 12. Also, holder 319 has a tetra pod shape core portion 322 having a depressed portion that is deeper than the height of this electric wire guide 310 and further, fan-shaped sidewall portions 324 with the curved outside surfaces connected to a protuberant portions at both sides of the depressed portion 321 and separated from central protrusion 320. These portions are united in one. A part of sidewall portion 324 is notched to form a flat portion 325 for escaping so that L-shaped electric wire guide 311 in main bobbin 4308 does not contact when main bobbin 308 is fit. Further, there are screw grooves 326 provided for fitting caps 302 to fit main bobbin 308 onto holder 319 on the outer surface portions at both sides of core portion 322 or the outer surface of sidewall portion 324.

As shown in FIG. 6, twelve bobbin assemblies 300 with electric wire 309 wound around were sequentially fit and both ends are fixed with caps 302. These bobbin assemblies 300 have coil portions 301, which are wound by reversing the winding directions alternately as described above and current flowing to coil portions 301, is in the same direction. Accordingly, there are two kinds of winding direction of electric wires. In order to discriminate the winding direction, for example, in the case of right-handed winding, groove 314 at the left side in FIG. 10 is used while in the case of left-handed winding, groove 314 at the right side is used.

Figure 13:
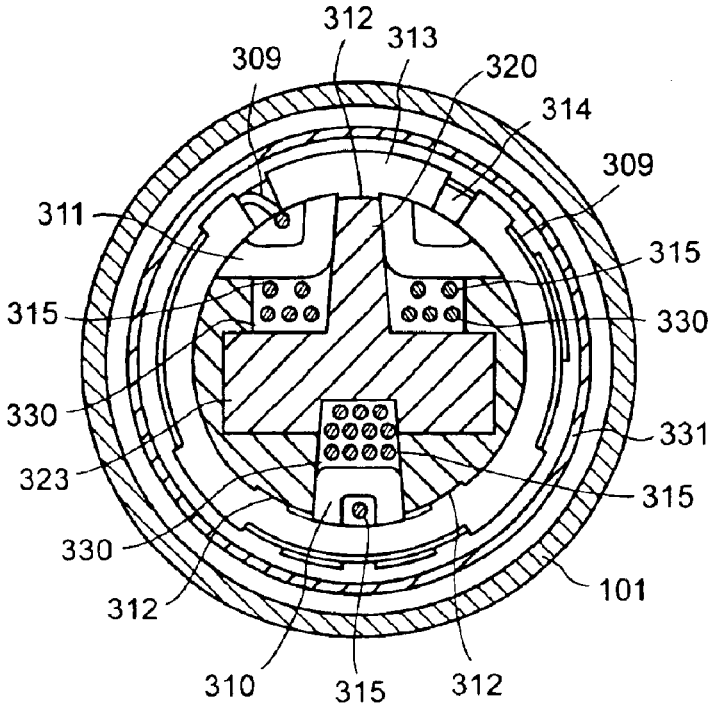
FIG. 13 a sectional view showing a definite construction of the induction heat fixing device in the first embodiment.

When bobbin assemblies 300 with electric wire 309 wound around them are installed sequentially to holder 319, ribs 312 are set at the height less than the diameter of electric wire 309 and therefore, electric wire 309 is not put in a gap between main bobbin 308 and holder 319 when fitting bobbin assemblies 300 in holder 319. When main bobbin 308 is fit into this holder 319, air gap portions ranging in the axial direction are formed at the lower side of left and right electric wire guides 311 and the upper side of horseshoe shape electric wire guide 310 between holder 319 and bobbin assemblies 300 as shown in FIG. 13. In air gap portions 330, lead wires 315 of electric wires 309 wound around other bobbin assemblies 300 sequentially connected other than own bobbin assembly 300 with electric wire 309 wound are arranged and lead out in the same direction. For example, a group of lead wires 315 connected to first terminal 305 shown in FIG. 7 is arranged in air gap portion 330 shown at the left side in FIG. 13, a group of lead wires 315 connected to second terminal 306 is arranged in the right side air gap portion 330, and a group of lead wires 315 connected to common terminal 304 is arranged in air gap portion 330 at the lower side.

Thus, it is possible to assemble coil portion 301 precisely as well as efficiently and furthermore, to construct with reduced error. Further, coil 111 is formed by fitting bobbin assemblies 300 with electric wire 309 wound around to the outer surface of holder 319, and covering the entirety of coil 111 with a heat resistive insulated tube 331 and a fixing device is thus constructed. Heat resistive insulated tube 331 is for improving insulation resistance between electric wire 309 and heat roller 101 and is provided to prevent unforeseen generation such as discharge, etc. between electric wire 309 and heat roller 101 even when electric wire 309 is damaged and insulation performance is deteriorated. If sufficient insulation performance can be maintained, this tube 331 can be eliminated. As holder 319 and bobbin assemblies 300 are arranged coaxially and a distance between each coil portion 301 and heat roller 101 can be kept constant as described above, it becomes possible to reduce uneven temperature.

According to the first embodiment of this invention as described above, it is possible to provide an induction heating magnetic field generator which is excellent in fixing of various size sheets of paper, practicality without defect, reliability and easy manufacturing and workability.

Figure 14:
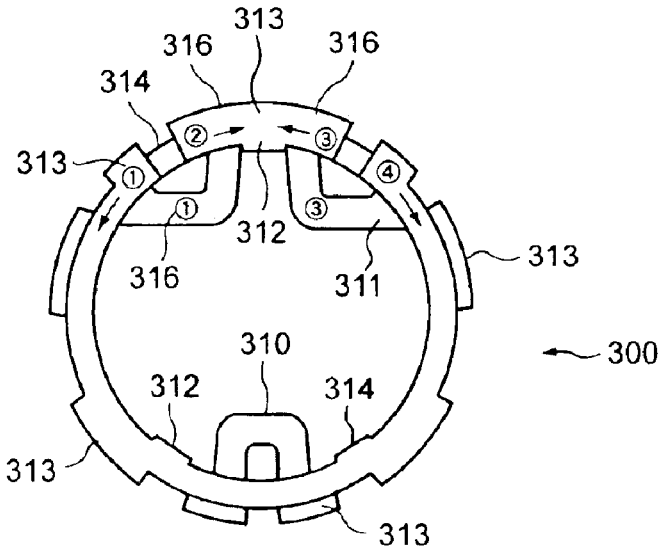
FIG. 14 is a plan view of the bobbin of the induction heat fixing device viewed from one end surface side in a second embodiment of this invention.
Figure 15:
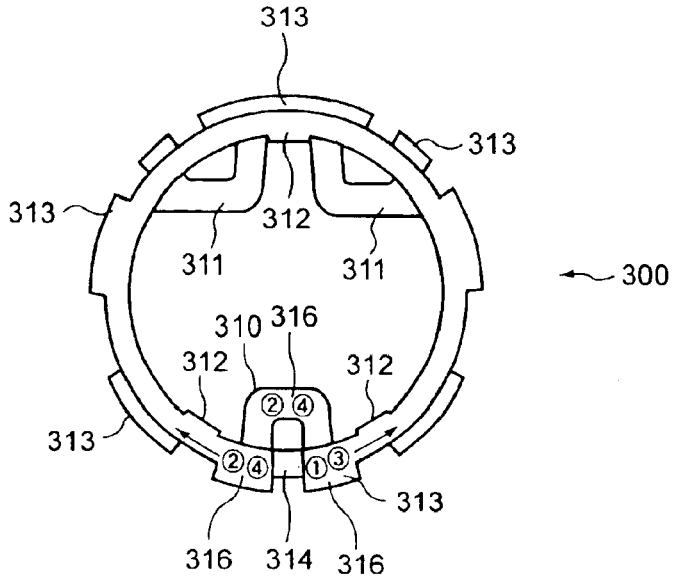
FIG. 15 is a plan view showing the bobbin shown in FIG. 14 viewed from the other end surface side.

Next, a second embodiment of this invention will be explained referring to FIG. 14 and FIG. 15. Further, the same component elements as those in the first embodiment will be assigned with the same reference numerals and detailed explanations thereof will be omitted.

As described in the first embodiment, two kinds of winding direction of electric wire 309 are available and in addition, the leading direction of lead wire 315 of electric wire 309 is set in one direction. Accordingly, the work is easy to perform when this winding direction of electric wires and the leading direction of lead wires are discriminated. That is, an arrow showing the winding direction of electric wires and numeric signs 316 are formed in one unit or printed on one end wherein two ditch portions 314 of main bobbin 308 are formed and both sides of each groove 314 of L-shape electric wire guide as shown in FIG. 14. Further, signs 316 comprising numerals for sorting required electric wires 309 to pass lead wires 315 through electric wire guides 311 are formed. On the other hand, on the other end of main bobbin 308, arrows and numerical signs 316 are formed in one unit or printed similarly at both sides of groove 314 and signs 316 comprising numerals are also formed on the end of horseshoe shape electric wire guide 310 as shown in FIG. 15.

These arrows and numeral signs 316 will be explained taking a numeral ① shown at one end in FIG. 14 as an example. That is, electric wire 309 at the numeral ① side shows that it is the end of electric wire 309 positioned at a high voltage side and its one end is inserted into L-shape electric wire guide 311 and right-handed wound inward in the arrow direction through groove 314. The terminal of this electric wire 309 is led out to this side from groove 314 in FIG. 15. Further, in the case of the numeral ② shown in FIG. 14, it is shown that one end of electric wire 309 is positioned at this side in FIG. 14 and is wound counter-clockwise and its terminal end is led out to the other opposite side (the end direction shown in FIG. 14) through horseshoe shape electric wire guide 310 via groove 314 shown in FIG. 15.

Thus, beginning and ending positions of wire winding and signs of arrows and numerals show winding directions, erroneous assembling in the manufacturing stage of coil portion 301 is prevented. Furthermore, even when coil portions 301 are completed individually, it is possible to easily check whether coils are assembled as designed and suppress manufacture of detective products.

It is also possible to indicate directions with signals 316 of arrows and numerals by making an arrow in a shape of ditch portions 314 of flange 313 partially notched to a triangle shape. It is also possible to use graphic displays of projection, triangle, square, etc. corresponding to numbers instead of numerals and use by functionally combining these graphic symbols.

Further, when this sign 316 is formed on flange 313, it becomes easy to judge type and the winding direction of electric wires 309 to be inserted. It is possible to form the sign on the end of peripheral surface of main bobbin 308 on which electric wires 309 are wound or directly form on the end of main bobbin 308.

Figure 16:
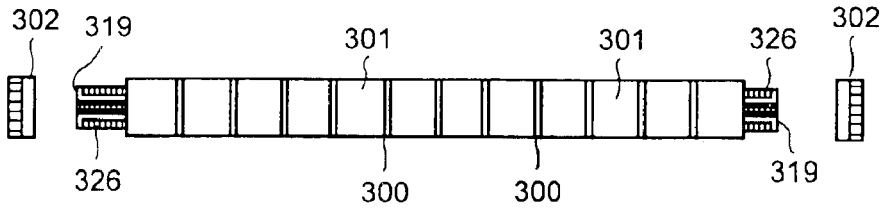
FIG. 16 is a plan view showing one example of a magnetic field generator of the induction heat fixing device in a third embodiment of this invention.
Figure 17:
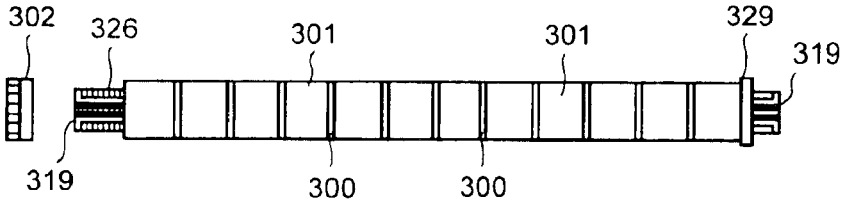
FIG. 17 is a plan view showing another example of the magnetic field generator shown in FIG. 16.

Next, a third embodiment of this invention will be explained referring to FIG. 16 to FIG. 18. Further, the same component elements as those in the first and the second embodiments will be assigned with the same signs and the detailed explanations thereof will be omitted.

Plural coil portions 301 comprising main bobbins 308 with electric wires 309 wound around are sequentially fitted on the outer surface of holder 319 and it is necessary to fix these plural coil portions 301 on holder 319. For this purpose, a screw groove is formed at both ends of holder 319 and caps 302 are screwed in this screw groove 326 from both ends of holder 319 to tightly hold and fix coil portion 301. Caps 302 are screwed in from both ends of holder 319 and therefore, if the position of the magnetic field generator is inadequate, the entire coil portion 301 can be moved in the axial direction and set the magnetic field generator at the optimum position by loosening one of caps 302 and deeply screwing the other cap 302.

Further, caps 302 at both ends of holder 319 are removable. When a defective product is mixed in plural coil portions 301 or any one is broken during the use, a cap 302 most close to that defective coil portion 301 can be removed and the exchange work is completed efficiently by exchanging small quantity of coil portions 301. Furthermore, the repair and/or exchange can be made in a short time. Further, an induction heat fixing device can be adjusted to the optimum position and induction heat can be effectively used.

When molded main bobbins 308 are used, variation in longitudinal size of bobbin assembly 300 is known or predictable in advance. Therefore, it is possible to construct one side as a stationary type lock 329 and one side only is fixed with a screwing cap 302 as shown in FIG. 17.

In this case, one side is constructed with stationary type lock 329 and bobbin assembly 300 can be inserted into holder 319 only through one side. Thus, the possibility of erroneous insertion decreases to half and the construction also becomes simple.

Figure 18:
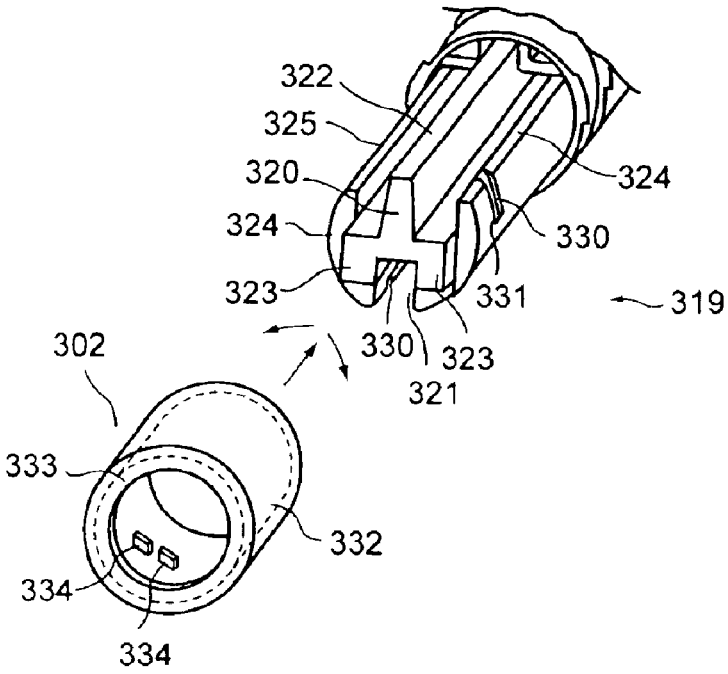
FIG. 18 is a plan view showing further another example of the magnetic field generator shown in FIG. 16.

Further, as shown in FIG. 18, cap 302 with a locking collar formed at one end of main cap 332 and boss 334 formed in the inside of main cap 332 at a point inward from collar 333 by a specified distance is used, an air gap portion 330 fitting to this boss 334 is formed in the circumferential direction from a flat portion 325 of a sidewall portion 324 of holder 319, and an insulated tube 331 is formed in this air gap portion 330.

In this construction, cap 302 is inserted into the end of holder 319 and bosses 334 are engaged with air gap portion 330. Thereafter, when cap 302 is rotated in the direction along air gap portion 330, the tips of bosses engage with insulated tube 331 in air gap portion 330 and cap 302 can be fixed to the end face of holder 319. When this rotary lock type construction is adopted, cap 302 can be attached/removed more easily.

Further, instead of providing insulated tube 331 in air gap portion 330, it is possible to hold bosses 334 of cap 301 in insulated tube 330 by narrowing the width insulated tube gradually in its circumferential direction. In addition, it I also possible to construction caps 302 inserted into both ends in combination of different fixing methods.

When bobbin assemblies 300 and holders 319 are arranged coaxially, coil portions 301 can be precisely and efficiently assembled and furthermore, error can be reduced. Further, a fixing device is constructed by fitting bobbin assemblies 300 with electric wires 309 wound around to the outer surface of holder 319 to coil 111, which is then covered by heat resisting insulated tube 331 and installed in heat roller 101. This heat resisting insulated tube 331 is to promote the insulation resistance between electric wire 309 and heat roller 101 and is provided to prevent generation of unforeseen troubles such as discharge, etc. even when electric wire 309 is bruised and insulation performance is deteriorated. When sufficient insulation resistance can be maintained, this heat resisting insulated tube can be eliminated. Thus, as holder 319 and bobbin assembly 300 are arranged coaxially and a distance between each oil portion 301 and heat roller 101 can be kept almost constant, it becomes possible to reduce uneven temperature of heat roller 101.

Next, a fourth embodiment of this invention will be explained referring to FIG. 19 to FIG. 28. Further, the same component elements described in the first, second or third embodiments are assigned with the same reference numerals and the detailed explanation there of will be omitted here.

Figure 19:
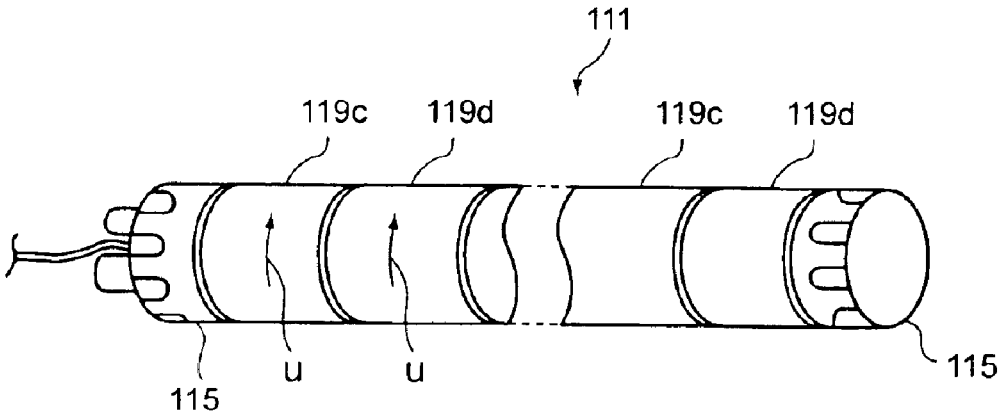
FIG. 19 is a schematic perspective diagram showing an induction coil of the induction heat fixing device in a fourth embodiment of this invention.
Figure 23:
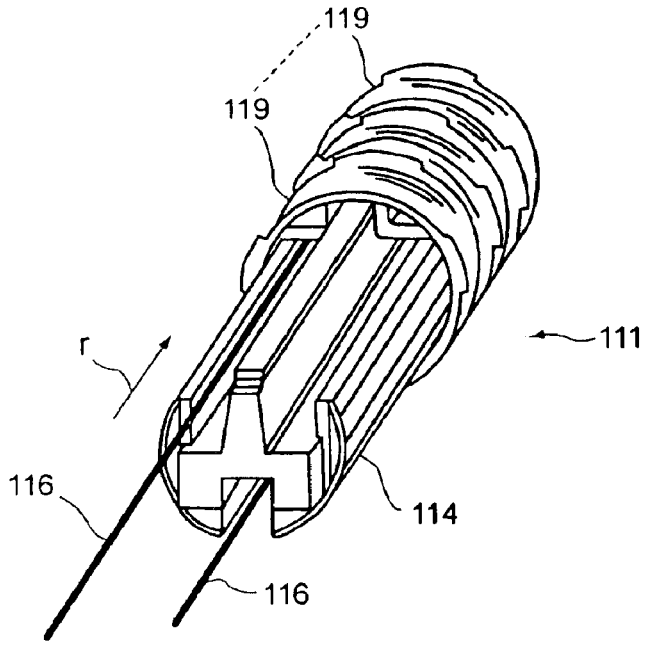
FIG. 23 is a schematic perspective diagram showing the assembling process of an induction coil.
Figure 24:
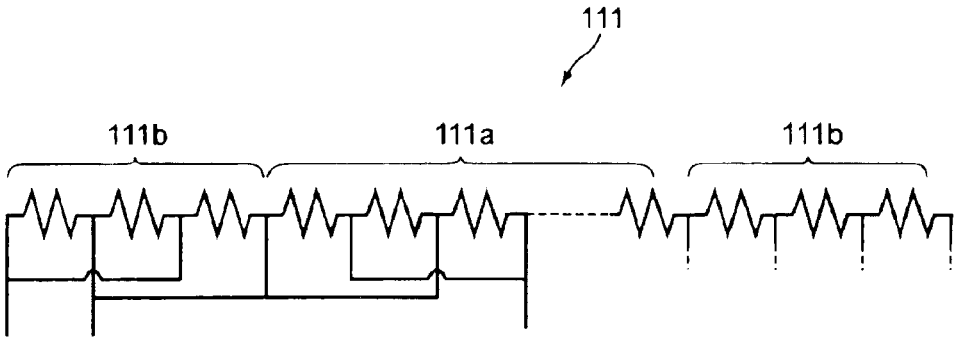
FIG. 24 is a schematic explanatory diagram showing the wiring of coil units.

As shown in FIG. 23, coil 111 is composed of 12 coil units 119 divided into No. 1 through No. 12. 12 coil units 119 are inserted into a holder 114 almost in the same length as heat roller 101 and fixed to holder 114 by screwing a screwed ring 115 into both ends of holder 114 as shown in FIG. 19.

Figure 22:
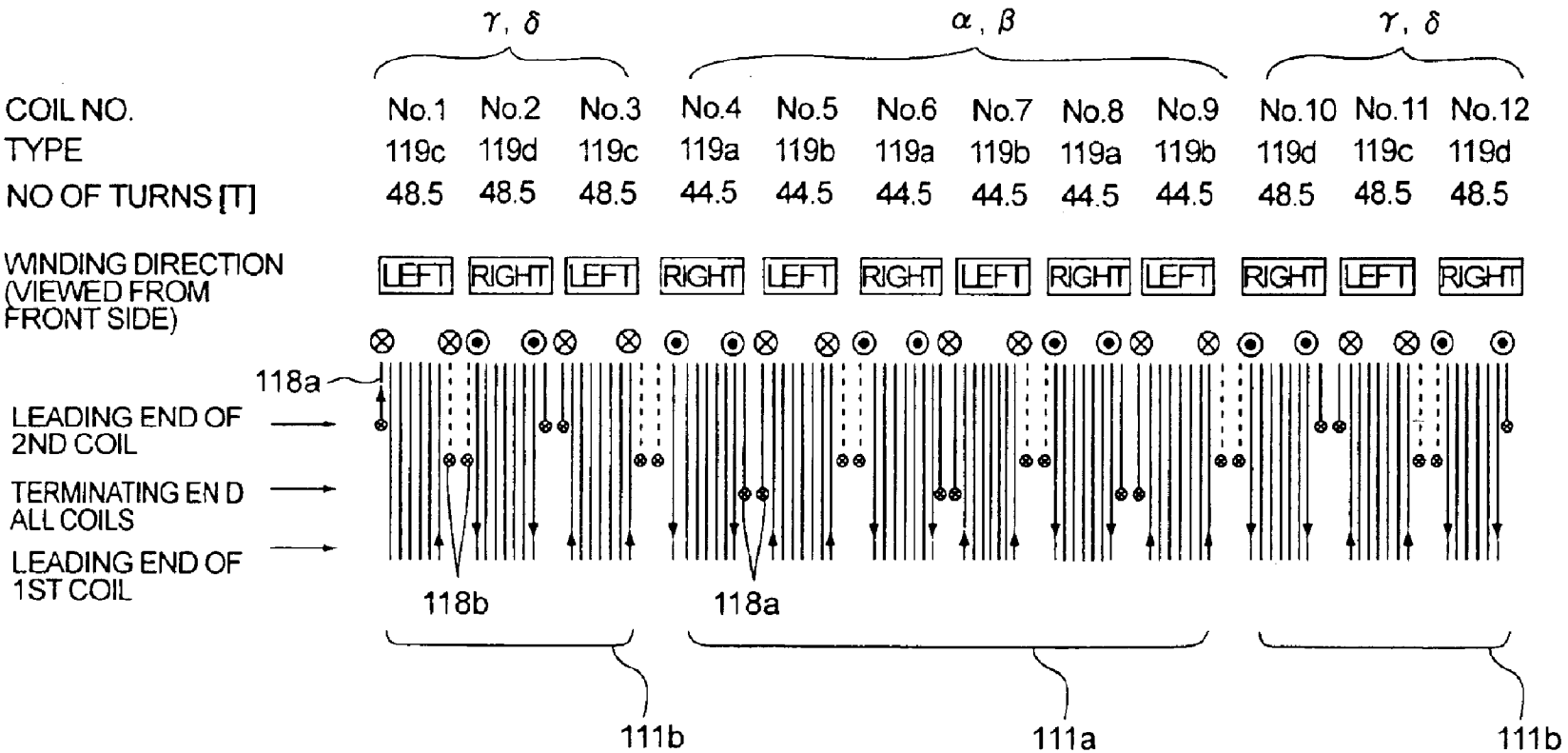
FIG. 22 is a schematic explanatory diagram showing the arrangement of coil units.

Coil 111 is composed of first coil 111*a* and second coil 111*b* as shown in FIG. 22. That is, first coil 111*a* is composed of foil unit α 119*a* and coil unit β 119*b* by arranging total 6 unit from No. 4 to No. 9 alternately adjacent each other. Second coil 111*b* is composed of total 3 units of coil unit γ 119*c* and coil unit δ from No. 1 to No. 3 and from No. 10 to No. 12 alternately adjacent to each other.

Figure 20:
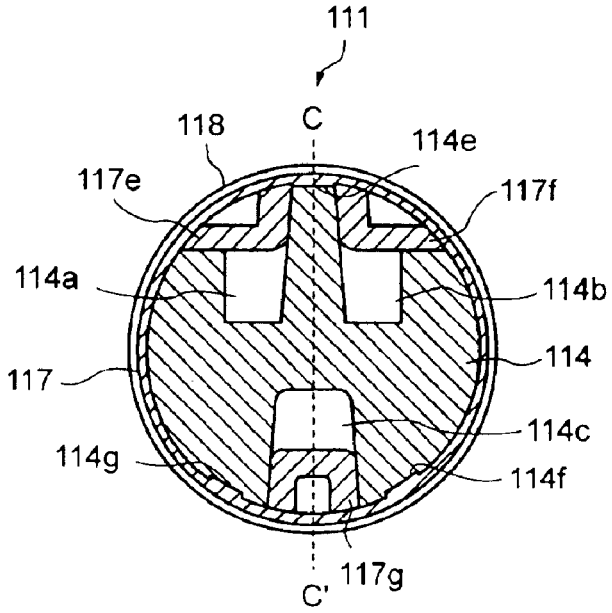
FIG. 20 is a schematic sectional view of the induction coil shown in FIG. 19.
Figure 21:
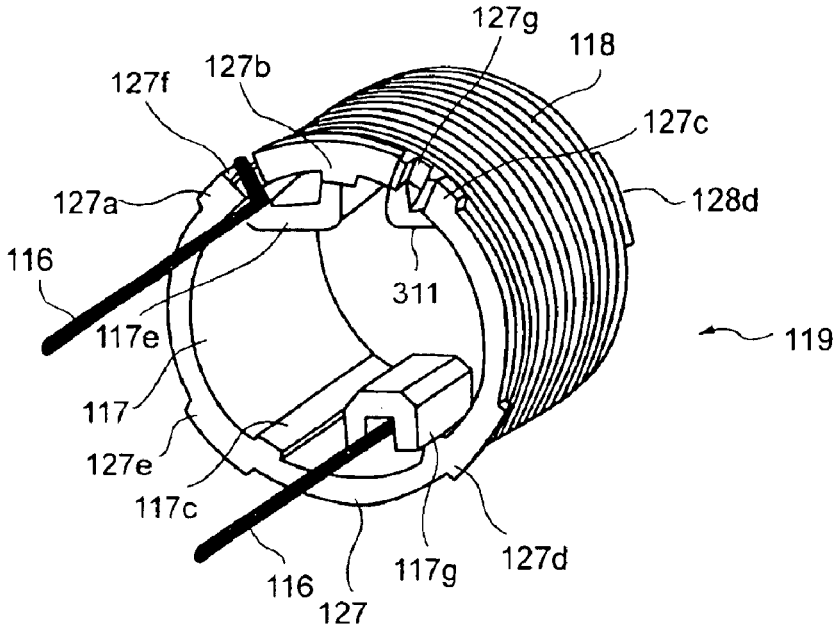
FIG. 21 is a schematic perspective diagram showing a coil unit.

Holder 114 is formed with a mold by molding insulating resin as shown in FIG. 20. On the surface of holder 114, first through third channels 114*a*, 114*b* and 114*c* are formed to pass coil winding wires. Further, on the surface of holder 114, first through third slits 114*e*, 114*f* and 114*g* are formed for positioning bobbins 117 that are coil supporting members. On the surface of holder 114, first through third channels 114*a*, 114*b* and 114*c* are formed for spatial channels to pass coil winding wires to coil units 119. Further, first through third slits 114*e*, 114*f* and 114*g* for positioning a bobbin 117 that is a coil supporting member are formed on the surface of holder 114. Twelve units of coil unit 119 that has a coil 118 with a winding wire wound around bobbin 117 are inserted into holder 114.

First through third channels 114*a*, 114*b* and 114*c* lead winding wires 116 of coils 118 of plural coil units 119 inserted into holder 114 separately so as to prevent the contact of the leading sides with the terminating sides of winding wires. Further, first and second channels 114*a* and 114*b* lead the leading side of winding wire 116 of coil 118 separately by first coil 111*a* and second coil 111*b*. There are 4 kinds of coil units 119 according to the number of coil windings; that is, a right-hand winding coil unit α 119*a* of 44.5 turns of coil 118, a left-hand winding coil unit β 119*b* of 44.5 turns of coil 118, a left-hand winding coil unit γ 119*c* of 48.5 turns of coil 118, and a right-hand winding δ 119*d* of 48.5 turns of coil 118.

Coil units 119 are arranged in the direction where potential differences of winding wires 116 become the same potential. In other words, second coils 111*b* at both ends shown in FIG. 22 are sequentially arranged so that about 1 kV coil leaders 118*a* of coil units δ 119*c* and 119*d* zero V coil terminals b are positioned next to each other. Similarly, first coils 111*a* shown at the center in FIG. 22 are sequentially arranged so that coil leaders 118*a* and coil terminals 118*b* of coil units α 119*a* and β 119*b* are positioned next to each other. Further, first and second coil 111*a* and 111*b* are arranged in the similar manner.

Figure 26:
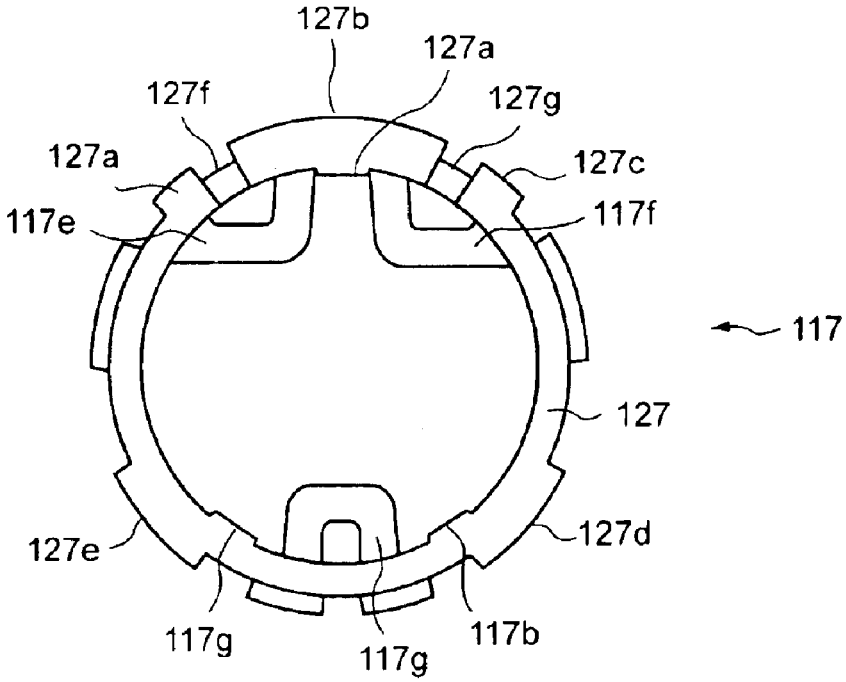
FIG. 26 is a side view showing the front side surface of a bobbin.
Figure 27:
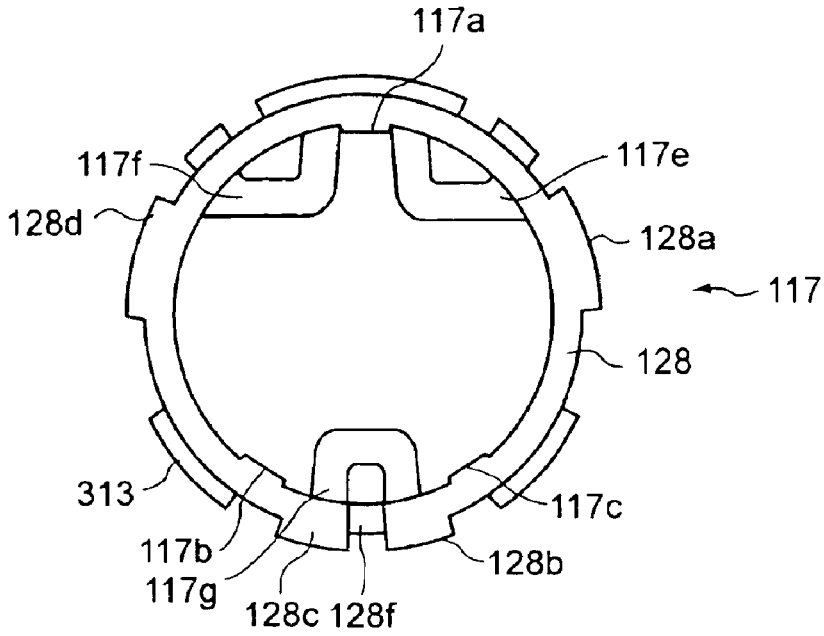
FIG. 27 is a side view showing the backside surface of a bobbin.
Figure 28:
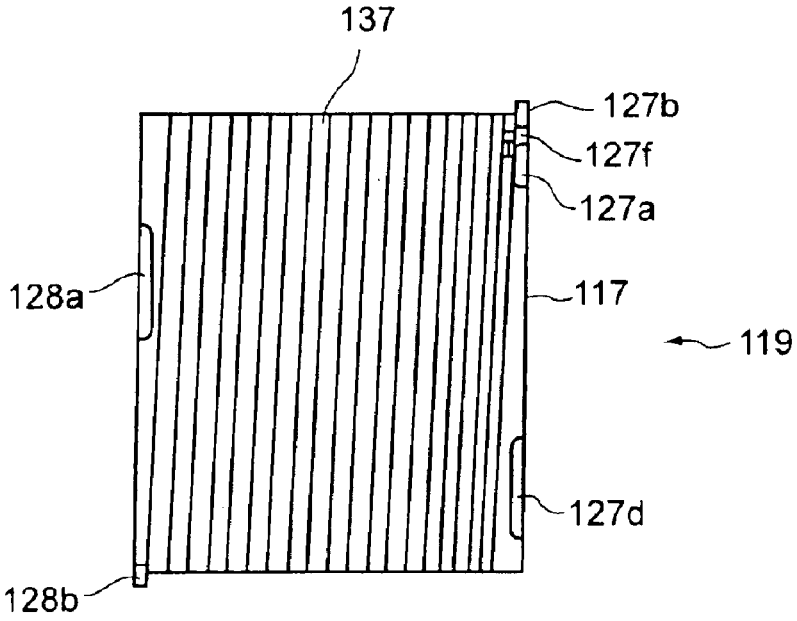
FIG. 28 is a side view showing the outer surface of a bobbin.

Bobbin 117 of coil unit 119 is formed with insulating resin using a mold. On the inner wall of bobbin 117, first through third ribs 117*a*, 117*b* and 117*c* that are guided by first through third slits 114*e*, 11*f* and 114*g* of holder 114 are formed by projecting as shown in FIG. 26. Holder 114 and bobbin 117 are coaxially positioned by inserting first through third ribs 117*a*, 117*b* and 117*c* into first through third slits 114*e*, 114*f* and 114*g* of holder 114.

Further, on the inner wall of bobbin 117, winding wire guides 117*e*, 117*f* and 117*g* which are tubular guides to insert one end of wiring wire 116 of individual coil unit 119 are formed.

First and second winding wire guides 117*e* and 117*f* pass winding wire 116 at high potential coil leader 118*a* of coil 118 wound on the outer surface face of bobbin 117 and lead it in the direction of coil 111 end through the inner wall side of bobbin 117 and thus, the assembling of coil 111 is made easy. Third winding wire guide 117*g* passes winding wire 116 at zero potential coil terminal 118*b* side of coil 118 wound on the outer surface face of bobbin 117 and leads it in the direction of coil 111 end through the inner wall side of bobbin 117 and thus, the assembling of coil 111 is made easy. First through third winding wire guides 117*e* to 117*g* are formed at positions that become line symmetry centering around the dotted line C–C' shown in FIG. 20.

Figure 25:
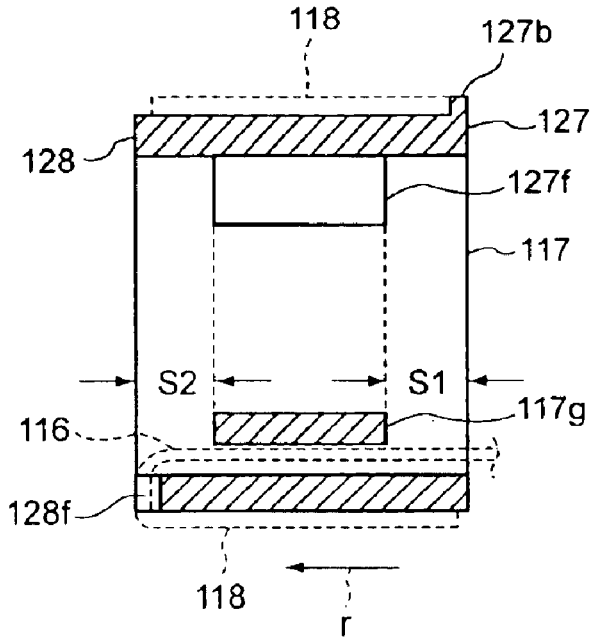
FIG. 25 is a schematic sectional view showing a bobbin.

Both ends of first through third winding wire guides 117*e* to 117*g* are controlled at the positions separated by a space S1 or S2 from both sides 127 and 128 of bobbin 117 as shown in FIG. 25. The ends of first through third winding wire guides 117*e* to 117*g* are so controlled that at least a first groove 127*f* or a second groove 127*g* or a third groove 128*f* described later is positioned inside from both sides 127 and 128 of bobbin 117. First through third grooves 127*f*, 127*g* and 127*f* are provided to prevent winding wire 116 from getting between adjacent bobbins 117 when adjoining plural coil units 119 sequentially.

Space S1 or S2 is provided to prevent winding wire 116 from getting between adjacent first through third winding wire guides 117*e* to 117*g* similarly to first through third grooves 127*f*, 127*g* and 128*f*.

In other words, the depth of grooves 127*f*, 127*g* and 128*f* is sufficient when it is the same diameter of winding wire 116. Accordingly, space S1 or S2 is sufficient when it is more than the diameter of winding wire 116. Further, when grooves 127*f*, 127*g* and 128*f* are provided at the same positions of adjoining bobbins 117 according to the arrangement of coil unit 119, the depth of the grooves can be ½ of the diameter of winding wire 116 and therefore, space S1 or S2 also can be more than the diameter of wiring wire 116.

However, when the length of first through third winding guides 117*e* to 117*g* is too short, winding wires cannot be guided sufficiently when inserting coil units 119 are inserted into holder 114 and winding wire 116 may be put between holder 114 and bobbin 117. From this, first through third winding wire guides 117*e* to 117*g* are desirable to have a length at least more than ¼ of bobbins.

On the front side face 127 of bobbin 117, first through fifth flanges 127*a* to 127*e* are formed to make coils 118 wounds on the outer surface face of bobbin 117 hardly come off. On the backside face 128 of bobbin 117, sixth to ninth flanges 128*a* to 128*d* are formed similarly to make coils 118 hardly come off. Flanges 127*a* to 127*e* on the front side face of bobbin 117 and flanges 128*a* to 128*d* on the back face 128 are formed by shifting phases when viewed from the axial direction.

Between first flange 127*a* and second flange 127*b* or between second flange 127*b* and third flange 127*c* on the front side face of bobbin 117, first or second groove 127*f* and 127*g* are formed to guide winding wire 116 at coil leading end 118*a* side to first or second winding wire guide 117*e* and 117*f* in the inside of bobbin 117. Between seventh flange 128*b* and eighth flange 128*c* on the back side face 128 of bobbin 117, third groove 128*f* is formed to guide winding wire 116 at coil terminal 118*b* side to third winding wire guide 117*g* in the inside of bobbin 117.

On the outer surface of bobbin 117, a coil guide 137 comprising spiral grooves is formed. This coil guide 137 is provided to wind winding wire 116 on bobbin 117 by the specified number of turns. Coil guide 137 is formed in a length corresponding to the number of turns of coil 118. That is, when winding wire 116 is wound on bobbin 117 along coil guide 136, coil 118 is always formed in the specified number of 44.5 or 48.5 turns.

When manufacturing coil 111 for heating heat roller 101, holder 114 and bobbins 117 are first formed with insulating resin in a single piece using molds. Bobbins 117 are formed in 4 types; bobbins with right-handed or left-handed winding wire 116 wounds in 44.5 turns and bobbins with right-handed or left-handed winding wire 116 wound in 48.5 turns. After forming these bobbins, coil guide 136 is formed on the outer surfaces of bobbins 117 by a slide type integral molding or a lath processing. Coil guide 137 having a length for winding wire around bobbin 117 by 44.5 turns and coil guide 137 having a length for winding wire around bobbin 117 by 48.5 turns are formed.

Then, coil unit a 119*a* having coil 118 formed by winding wire 116 on bobbin 117 along coil guide 137 by 44.5 right-hand turns is formed. In the similar manner, coil unit β 119*b* having coil 118 with 44.5 left-handed turns of winding wire, coil unit γ 119*c* having coil 118 with 48.5 left-handed turns of winding wire, and coil unit δ 119*d* having coil 118 with 48.5 right-handed turns of winding wire are formed.

Coil 118 in desired number of turns can be surely obtained only by winding a coil along coil guide 137 and a rewinding work can be prevented. Further, both sides of coil 118 wound around bobbin 117 are controlled by flanges 127*a* to 127*e* and 128*a* to 128*d* and the coil hardly comes off.

Winding wires 116 at coil leader side 118*a* after wound around coils pass through first groove 127*f* or second groove 127*g* to first channel 114*a* or second channel 114*b* that is formed between holder 114 and coil 111. Winding wires 117 at coil terminating end 118*b* sides pass through third groove 128*f* to third channel 114*c* formed between holder 114 and coil 111.

Coil 111 is assembled by installing first to through fourth coil units 119*a* to 119*d* sequentially to holder 114 from the arrow direction r as shown in FIG. 23 in the arrangement shown in FIG. 22. At this time, first through third ribs 117*a*, 117*b* and 117*c* formed by projecting to bobbins 117 of coil units 119*a* to 119*d* are positioned as guided by first trough third slits 114*e*, 114*f* and 114*g* of holder 114.

When the leading end of coil unit 119 is at the inner side in the arrow direction r shown in FIG. 23 and led to the end of coil 111 by passing through the inner side of bobbin 117 by the arrangement of file unit 119, winding wire 116 is put in first or second groove 127*f* or 127*g* and after passing through first or second winding wire guides 117*e* or 117*f* in bobbin 117, guided to first or second channel 114*a* or 114*b* formed between holder 114 and bobbin 117 and led to the end portion of coil 111. Similarly, when the end of coil unit 119 118*b* is at the inner side in the arrow direction r shown in FIG. 23 and is guided to the end of coil 111 after passing through the inside of bobbin 117, winding wire 116 is put in third groove 128*f* and after passing third winding wire guide 117*g* in bobbin 117, is guided to third channel 114*c* formed between holder 114 and bobbin 117 and led to the end of coil 111.

Thus, when coil units 119 are installed to holder 114 sequentially, it is possible to lead winding wire 116 at the inner side in the installing direction safely to the end direction of coil 111 by passing through one of first to third channels 114*a* to 114*c* without damage it by putting between holder 114 and bobbin 117.

Thus, coil 111 is formed by inserting 12 coil units 119 from No. 1 to No. 12 into holder 114 and fixing both ends with screwed rings 115. Hereafter, coil 111 is covered with an insulation cover 106 and assembled in heat roller 101. Heat roller 101 is thus completed.

When a driving signal of the same frequency (or near frequency) as resonance frequency f1 of the first series resonance circuit of high frequency generating circuit 120 is emitted from oscillator 141, in a fixing device 100 having heat roller 101, a transistor 126 is turned on by this driving signal and the first series resonance circuit is excited. When the first series resonance circuit is excited, current in the arrow direction u shown in FIG. 19 flows to No. 4 to No. 8 coil units 119 of first coil 111*a* and a high frequency magnetic field is generated from first coil 111*a* and eddy current is generated at the central portion of heat roller 101 in the axial direction by this high frequency magnetic field and the central portion in the axial direction of hear roller 101 is self heated by Joule heat by the eddy current.

Further, in fixing device 100, when a driving signal of the same frequency (or near frequency) as resonance frequency f2 of the second series resonance circuit of high frequency generating circuit 120 is emitted from oscillator 141, transistor 126 is turned on and the second series resonance circuit is excited as shown in FIG. 4. By the excitation of the second series resonance circuit, current in the arrow direction u shown in FIG. 19 flows to No. 1 to No. 3 and No. 10 to No. 12 of coil units 119 of second coil 111*b*, a high frequency magnetic field is generated from second coil lib and then, eddy current is generated at the central portion in the axial direction of heat roller 101 by this high frequency magnetic field and both sides in the axial direction of heat roller 101 are self heated by Joule heat generated by the eddy current.

After the surface temperature of heat roller 101 reached a ready temperature, the on/off of the excitation of first and second coils 111*a* and 111*b* is repeated by high frequency generating circuit 120 and a specified ready temperature is maintained. When the print operation is directed from control panel CPU 80 during this ready temperature, the required area of heat roller 101 is self heated according to a size of directed the sheet of paper S in fixing device 100.

That is, when fixing A4 size sheet S, first series resonance circuit is excited sequentially with two frequencies (f−Δf), (f+Δf) before and after resonance frequency f1 by oscillator 141 of high frequency generating circuit 120. As a result of the excitation of first series resonance circuit, a high frequency magnetic field is generated from first coil 111*a*, the central portion in the axial direction of heat roller 101 is self heated, the surface temperature of the central portion in the axial direction of heat roller 101 is set at a fixing temperature and the fixing is executed. Thereafter, ON/OFF of the excitation of first coil 111*a* is repeated, the surface temperature at the central portion in the axial direction of heat roller 101 is kept at the fixing temperature and a toner image formed on the sheet of paper S is fixed.

After completing the fixing, the ON/OFF of excitation of first and second coils 111*a* and lib is repeated by high frequency generating circuit 120. When the sheet of paper S directed to print is in a large size, the ON/OFF of excitation of first and second coils 111*a* and 111*b* by high frequency generating circuit 120 is repeated and the entirety of heat roller 101 is self heated, and the surface temperature of entire heat roller 101 is set at a fixing temperature and the fixing is executed.

According to the fourth embodiment as described above, first to third winding wire guides 117*e* to 117*g* are formed on the inner surface of bobbin 117 comprising coil 111 capable of energy saving, and when coil unit 119 is inserted into holder 114, winding wire 116 at the inner side in the inserting direction is inserted into either first to third winding wire guides 117*e* to 117*g* in bobbin 117. Accordingly, when coil nit 119 is inserted in holder 114, it is possible to prevent winding wire 116 from being put between unit 119 and holder 114 and coil 111 can be assembled easily and safely. Therefore, it is possible to improve production efficiency of coil 111, achieve cost reduction by mass production of coil 111, and obtain a fixing device using induction coils that are efficient in practicality and reliability. Further, when both sides of first to third winding wire guides 117*e* to 117*g* are controlled to provided at the inner positions from both sides of bobbin 117 as in the embodiments of this invention, the possibility of winding wire 116 from being put between adjoining winding wire guides 117*e* to 117*g* and damaged when units 119 are provided adjoining each other. Thus, a fixing device using induction coils excellent in the reliability is obtained.

Further, this invention is not limited to the fourth embodiment described above and can be designed variously, for example, the shape of coil supporting, etc. are not limited, and positions of flanges, grooves, etc. are optional. Furthermore, the number of coil units and sizes composing coil unit groups are also not limited and optional depending on the distribution of a heating area of heating members. Further, the number of spatial channels to pass winding wires of coils formed on a holder is optional according to the number of coil unit groups.

In addition, a material for heating member can be stainless steel when it is conductive but a material that is able to reduce energy loss when heated is preferred and a material of winding wire is also optional but material that is capable of reducing current loss is desirable. Further, frequency of high frequency power for generating magnetic field in coil units is also not restricted and resonance frequency for exciting plural coil units are also optional.

As described above in detail, according to this invention, it is possible to form desired induction coils for achieving energy saving extremely easily and safely and manufacturing cost can be reduced through mass production of induction coils. Accordingly, a fixing device using induction coils excellent in practicality and reliability can be provided.

What is claimed is:

1. An induction heat fixing device comprising:

a heat roller;

a magnetic field generator including a cylindrical main bobbin with an electric wire wound around to form a coil on the outer surface and flanges formed at both ends of the main bobbin;

a pressure roller that rotates jointly with the heat roller while kept in contact with the heat roller; and electric wire guides formed on the inner surface of the main bobbin corresponding to grooves with signs indicating a type of electric wire shown on the electric wire guides and the main bobbin.

2. The device according to claim 1, wherein the flanges of the main bobbin are arranged at positions different from each other in the axial direction of the main bobbin.

3. The device according to claim 1, wherein the main bobbin has grooves formed in a radial pattern at both sides of the main bobbin to communicate inner and outer surfaces of the main bobbin, and wherein the main bobbin has flanges that are arranged at both sides of the grooves.

4. The device according to claim 1, wherein the signs includes a winding direction of the electric wire.

5. The device according to claim 4, wherein the sign indicating the winding direction of the electric wire is provided on the flange surfaces provided at both sides of the grooves.

* * * * *